United States Patent [19]

Vezirian et al.

[11] Patent Number: 4,684,015

[45] Date of Patent: Aug. 4, 1987

[54] VENDING PACKAGE

[76] Inventors: Edward Vezirian, 110 Firwood, Irvine, Calif. 92714; Earle L. Hinton, 851 Brighton, La Habra, Calif. 90631

[21] Appl. No.: 915,002

[22] Filed: Oct. 3, 1986

Related U.S. Application Data

[63] Continuation-in-part of Ser. No. 876,725, Jun. 20, 1986.

[51] Int. Cl.[4] ..... A45C 11/00

[52] U.S. Cl. ..... 206/19; 206/303; 206/217; 220/20; 220/359

[58] Field of Search ..... 206/19, 303, 217; 215/232; 220/20, 359

[56] References Cited

U.S. PATENT DOCUMENTS

| | | | |
|---|---|---|---|
| 3,080,964 | 3/1963 | Robinson et al. | 206/303 |
| 3,514,029 | 5/1970 | Powell | 206/19 |
| 3,796,813 | 3/1974 | Kurland | 206/217 |
| 3,852,485 | 12/1974 | Beall | 206/303 |
| 4,475,652 | 10/1984 | Heard | 206/303 |
| 4,518,017 | 5/1985 | Hennon et al. | 206/303 |
| 4,582,197 | 4/1986 | Lin | 206/217 |

*Primary Examiner*—Joseph Man-Fu Moy

[57] ABSTRACT

A disposable individual serving dual compartment package for comestibles is disclosed, having a first compartment for a bread portion and a second compartment for a liquid portion, it is directed toward the packaging of communion elements for use in religious services.

4 Claims, 4 Drawing Figures

VENDING PACKAGE

This application is a continuation in part of application Ser. No. 06/876,725 filed 06/20/86 and bearing the same title.

BACKGROUND OF THE INVENTION

1. Field of the Invention

This invention pertains to a package for purveying of individual servings of comestibles.

More specifically, this invention is directed to a duel compartment throwaway package for separately and sanitarily purveying two dissimilar comestibles, at least one of which is liquid. This invention is directed to an improved method of distributing Communion elements in religious sevices.

2. BRIEF DESCRIPTION OF THE PRIOR ART

The beverage industry and the canning industry have been largely founded on the concept of small disposable containers in which to package their products. Containers of ceramic clay or glass, employing cork stoppers for example, were probably the earliest such packages used, and were of a size to provide a small number of servings as to a family or small group. Pharmacists, distillers, and vintners found such packaging to be economical enough for their products. Brewers and soft drink manufacturers required convenience containers of smaller individual serving size. The Ball Mason glass jar and closure system brought the concept to home canning use. Metal tins found use in commercial canning, however the inappropriate use of such tins for continued storage of the contents after the seal had been broken led to many cases of food poisoning. Protective coatings for the inside of such tins, and the use of chemical preservatives have made the metal can a very popular container.

The fast food industry fostered the development of individual packages for dry items like sugar, salt and pepper, and then moist items like catsup, mustard, and relish. Such packages helped to solve problems of convenience, sanitation, and serving size in an economical manner.

Many family restaurants have found the advantages of the individual creamer, and the individual jam/jelly server to be of particular value in their operations.

A dual compartment package for the vending of a snack-sized portion of cheese spread in a first sealed compartment, and crisp fresh crackers in a second sealed compartment has been marketed for some time. This package is formed of light gage sheet plastic, and the two compartments are closed by means of a single impervious cover sheet which is heat sealed to the package.

The problems of the fast food industry in handling small amounts of comestibles to large numbers of people have been faced for centuries by churches in the distribution of communion elements.

SUMMARY OF THE INVENTION

An object of this invention is to provide a package which will offer the advantages of sanitary vending and individual convenience in the mass distribution of ceremonial food and drink items at religious services, for example, unleavened bread and grape juice or wine.

Another object of this invention is to eliminate the task of manually filling the great multiplicity of small cups used in such ceremonies, permitting the filling to be done well in advance and under sanitary conditions by modern high speed machines, avoiding common spills and waste.

Individual cups have an outer perimetric first flat annular lip at the top and an outer first wall extending downward from the inner edge of the first flat lip to an annular cusp defining the bottom of a first chamber. An intermediate second annular wall extends upward from the inner side of the annular cusp to the outer edge of a second flat annular lip which is co-planar with the first flat annular lip, at the top of the cup. A central third annular wall extends downward from the inner edge of the second flat annular lip to a central floor defining the bottom of a second chamber. The first chamber, which is intended to house the liquid comestible element, surrounds the second chamber, intended to house the solid comestible element, much as a mote surrounds a castle.

The annular cusp generally defines the lowest extent of comestible containing chamber. The design of the exterior portion of the cup below the cusp is optionally determined by esthetics or economics, or to the stability of the cup as it rests on a table, for example.

The cup, intended to be a disposable single serving container, may be formed of a thermoplastic, polystyrene for example.

After the cup is filled, a closure sheet is heat sealed simultaneously to the first annular lip and the second annular lip at the top of the cup to separately contain and preserve the comestibles within. The closure sheet is equipped with a pull tab to provide for its easy, convenient, and timely removal. The closure sheet is typically a membrane of thermoplastic, thermoplastic coated paper, or paper-backed foil or plain foil treated with a heat activated adhesive. The use of such an adhesive, however, is less desirable in that it tends to leave objectionable deposits on the rim of the cup from which the user will drink.

An advantage of this invention is that the packages may be quickly and easily refrigerated due to the small size of the portions, and to the relatively large surface area presented by the thin cup between the contents and the cold air of the refrigerator.

Another advantage of this invention is that unused portions are easily and conveniently returned to the storage refrigerator to be used in later ceremonies, whereas in the prior art it proved to be more realistic to discard the remaining portions.

The above noted objects and advantages of the present invention will be more fully understood upon a study of the following detailed description in conjunction with the detailed drawings.

DESCRIPTION OF THE PREFERRED EMBODIMENT AND BEST MODE FOR CARRYING OUT THE INVENTION

Figure 1:
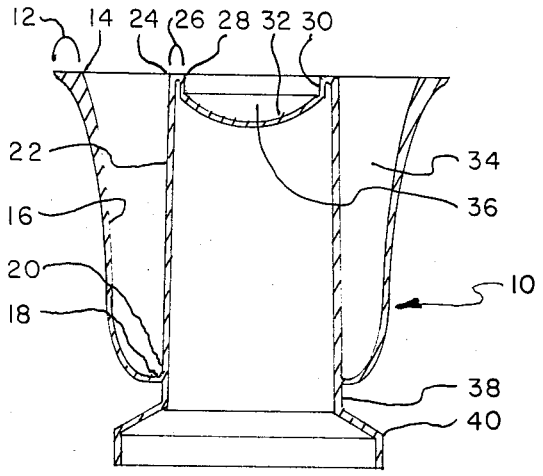
FIG. 1 is a cross sectional view of the preferred embodiment of the dual compartment disposable package, with a short stem and a flanged pedestal base below the annular cusp.

Referring now to FIG. 1, a dual chamber, individual serving, disposable food package, is generally designated as 10. An outer first wall 16 extends downward from an inner edge 14 of an outer perimetric first flat annular lip 12 to cusp 18. Inner second wall 22 extends upward from an inner edge 20 of cusp 18 to the outer edge 24 of second flat annular lip 26. First wall 16, cusp 18, and second wall 22 together define first chamber 34. Central third wall 30 extends downward from the inner edge 28 of second flat annular lip 26 to central floor 32. Central third wall 30 together with central floor 32 defines open second chamber 36.

Annular cusp 18 is shown with a stem 38 extending downward to pedestal base 40, providing a form similar to a chalice, and a convenient and stable base for resting on a table.

Figure 2:
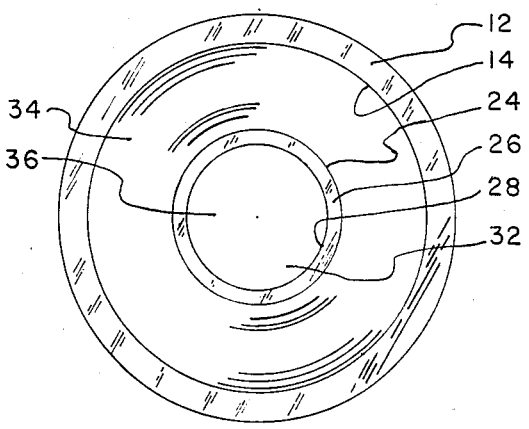
FIG. 2 is a top view of the open dual chamber package showing the first and second flat annular lips, and the first chamber surrounding the second chamber.

FIG. 2 shows, by way of a top view, the relative positions of the two co-planer flat annular lips 12 and 26 which are provided for the secure heat sealing of the closure sheet 42 (not shown). First chamber 34 surrounds second chamber 36.

Figure 3:
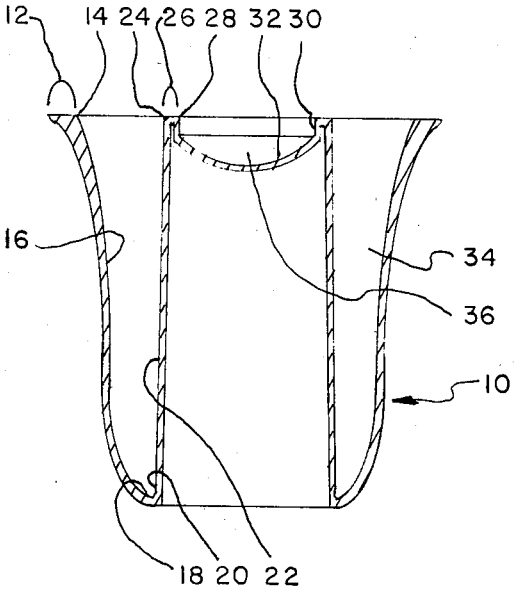
FIG. 3 is a cross sectional view showing an alternate design of the package, intended to rest on the annular cusp.
Figure 4:
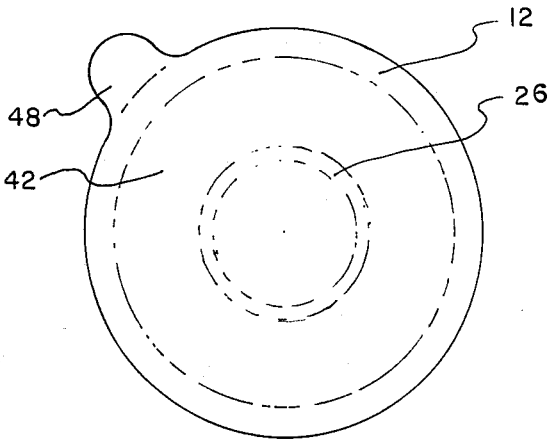
FIG. 4 is a top view of the closed disposable package showing the closure sheet heat sealed in place and equipped with a convenient pull tab for opening.

FIG. 3 illustrates an alternative package which is intended to rest upon the annular cusp directly, and is not provided with the stem and pedestal of FIG. 1. This design is otherwise identical to that depicted in FIG. 1 and the same numbers are used to identify the respective parts FIG. 4 is a top view of the package after filling and closing with closure sheet 42. The outlines of the flat annular lips 12 and 26 can be seen because of the heat sealing process. The pull tab 48, formed by the closure sheet 42 outboard of the flat annular lip 12 provides for the convenient timely removal of the closure sheet 42.

Light gage thermoplastic or thermoplastic coated paper is the preferred material for manufacture of this closure sheet in that it is readily heat sealed to the dual chambered thermoplastic package thus eliminating the use of adhesive on the closures. Adhesives often leave some residue on the annular lip which may be perceived as unpleasant when drinking the liquid portion contained in the first chamber 34 of the dual package.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A dual compartment disposable individual serving comestibles package for sanitarily purveying a pair of separated and dissimilar portions comprising:

an outer perimetric first flat annular lip, an outer first wall extending downward from an inner edge of said first flat annular lip to an annular cusp, an intermediate second annular wall extending upward from an inner side of said annular cusp to a plane containing said first annular lip, thus forming an open annular first chamber between said outer first annular wall and said intermediate second annular wall, a second flat annular lip inwardly extending within said plane from said second annular wall, to a central third annular wall, said third annular wall extending downward from an inner edge of said second flat annular lip, to a central floor, thus forming an open central second chamber within said third annular wall and above said central floor, and a separated impervious membranous closure sheet adapted to be bonded simultaneously to co-planer said first flat annular lip and said second flat annular lip, thus to separately retain and preserve said comestibles within said disposable individual serving package.

2. The invention as described in claim 1 wherein a fourth annular wall extends downward from said annular cusp thus forming a stem, and a base flange extending radially outward from a lower end of said fourth annular wall, said base flange adapted to provide a stable pedestal for said serving package.

3. The invention as described in claim 1 wherein said closure sheet has a pull tab formed outboard of said first annular lip to aid in removal of said closure sheet.

4. A dual compartment disposable individual serving comestibles package for sanitarily and separately purveying a bread portion and a liquid portion comprising:

an outer perimetric first flat annular lip, an outer first wall extending downward from an inner edge of said first flat annular lip to an annular cusp, an intermediate second annular wall extending upward from an inner side of said annular cusp to a plane containing said first annular lip, thus forming an open annular first chamber between said outer first annular wall and said intermediate second annular wall, a second flat annular lip inwardly extending within said plane from said second annular wall, to a central third annular wall, said third annular wall extending downward from an inner edge of said second flat annular lip, to a central floor, thus forming an open central second chamber within said third annular wall and above said central floor, and a separate impervious membranous closure sheet adapted to be bonded simultaneously to co-planer said first flat annular lip and said second flat annular lip, thus to separately retain and preserve said comestibles within said disposable individual serving package.

* * * * *